US006925744B2

(12) United States Patent
Kincel

(10) Patent No.: US 6,925,744 B2
(45) Date of Patent: Aug. 9, 2005

(54) MODULAR FIREARM BUTTSTOCK

(75) Inventor: Eric Stephen Kincel, Coeur d'Alene, ID (US)

(73) Assignee: Abrams Airborne Manufacturing, Inc., Tucson, AZ (US)

( * ) Notice: Subject to any disclaimer, the term of this patent is extended or adjusted under 35 U.S.C. 154(b) by 0 days.

(21) Appl. No.: 10/843,246

(22) Filed: May 11, 2004

(65) Prior Publication Data

US 2005/0108915 A1 May 26, 2005

Related U.S. Application Data

(60) Provisional application No. 60/470,050, filed on May 13, 2003.

(51) Int. Cl.[7] ..... F41C 23/00
(52) U.S. Cl. ..... 42/71.01; 42/72
(58) Field of Search ..... 42/71.01, 72, 73, 42/74, 85

(56) References Cited

U.S. PATENT DOCUMENTS

| | | | | |
|---|---|---|---|---|
| 746,859 | A | | 12/1903 | Marble |
| 1,266,024 | A | | 5/1918 | Kennedy |
| 1,485,456 | A | | 3/1924 | Frommer |
| 1,489,677 | A | | 4/1924 | Stampfli |
| 2,100,514 | A | * | 11/1937 | Miller et al. ..... 42/71.01 |
| 2,298,678 | A | | 10/1942 | Chase |
| 2,495,977 | A | * | 1/1950 | Madsen ..... 42/71.01 |
| 2,667,005 | A | | 1/1954 | Weis |
| 3,011,283 | A | | 12/1961 | Lunn et al. |
| 3,618,248 | A | | 11/1971 | Into et al. |
| 4,512,101 | A | | 4/1985 | Waterman, Jr. |
| 4,850,127 | A | | 7/1989 | Davis et al. |
| 5,048,213 | A | | 9/1991 | Gerhard |
| 5,068,991 | A | | 12/1991 | Reed |
| 5,225,613 | A | | 7/1993 | Claridge |
| 5,755,055 | A | | 5/1998 | Thompson et al. |
| 5,907,918 | A | | 6/1999 | Langevin et al. |
| 5,924,233 | A | | 7/1999 | Strobel |
| 6,012,246 | A | | 1/2000 | Robinson et al. |
| 6,481,143 | B2 | * | 11/2002 | McCarthy ..... 42/74 |
| 6,543,172 | B1 | * | 4/2003 | Armstrong ..... 42/71.01 |
| 6,651,371 | B2 | | 11/2003 | Fitzpatrick et al. |
| 6,779,289 | B2 | * | 8/2004 | Kay ..... 42/75.03 |
| 2003/0101631 | A1 | | 6/2003 | Fitzpatrick et al. |
| 2003/0200693 | A1 | * | 10/2003 | Seifert ..... 42/71.01 |
| 2004/0016167 | A1 | | 1/2004 | Fitzpatrick et al. |

* cited by examiner

*Primary Examiner*—J. Woodrow Eldred
(74) *Attorney, Agent, or Firm*—Fay, Sharpe, Fagan, Minnich & McKee, LLP

(57) ABSTRACT

A buttstock for a firearm is provided and includes a buttstock frame and a buttstock accessory. The buttstock frame has a frame wall with an exterior surface. The buttstock accessory is supported on the buttstock frame along the exterior surface.

29 Claims, 14 Drawing Sheets

MODULAR FIREARM BUTTSTOCK

This application claims priority from U.S. Provisional Patent Application No. 60/470,050 filed on May 13, 2003, which is hereby incorporated herein by reference in its entirety.

BACKGROUND

The present invention broadly relates to the art of firearms and, more particularly, to a firearm buttstock adapted for selective mounting of related accessories and components.

It will be appreciated that the present invention finds particular application in conjunction with firearms, such as ARMALITE AR15/M16 rifle series models and COLT CAR15/M4 carbine series models, and is shown and described herein with specific reference to these weapons. However, it is to be distinctly understood that the present invention has broader application, and is equally applicable for use on many other shoulder fired weapon of various types, makes and models. For example, the subject modular buttstock can also be used on FABRIQUE NATIONALE FAL, SIG 5-series and HECKLER & KOCH G-series rifles, for example; AUTOMAT KALASHNIKOV 47/74, ROBINSON ARMS M96 and HECKLER & KOCH XM8 carbines, for example; and REMINGTON 870, MOSSBERG 500 and BENELLI M3 SUPER 90 shotguns, for example. Accordingly, the subject disclosure and reference to ARMALITE and COLT models is not to be in anyway construed as a limitation of the present invention to such specific applications.

From the early days of firearm history, shoulder-fired small arms have had the ability to store items in small compartments, usually located in the firearm's buttstock. From the earliest accounts, dating back hundreds of years to the use of matchlock, flintlock and related firearms, the buttstock of firearms have included a compartment to house various items, such as fuses, flints, percussion caps, and patches, to aid the user in being prepared. The intent was for the firearm to function as closely to a self-contained unit as possible. This lowered the chances of the shooter being caught off guard and without vital firing components.

With the progress of the last two hundred years or so, modern firearm technology has reduced the need for a compartment to house firing components. More modern firearms typically use a similar compartment to aid in the care of firearms with components, such as firearm cleaning kits, typically being stored therein.

For example, shoulder-fired weapons, such as the MAUSER bolt-action systems of the late 1800s to present and the AUTOMAT KALASHNIKOV, Model 1947 (also known as AK47), use the buttstock to carry some of the components to aid in fieldstripping and cleaning the firearm. These mentioned firearms also rely on an accessible area to house a bore-cleaning rod. Usually located under the firearm's barrel, within the foregrip, the cleaning rod (usually in a similar length to the firearm's barrel) is unobtrusive, but easily accessible, to aid in the firearm's cleaning or to dislodge a stuck cartridge casing that failed to extract under normal means.

On some modern shoulder-mounted firearms, the cleaning components are located at the rear portion of the buttstock just under the buttplate. Access to these components is obtained by removing the buttplate (by use of a latch system) or through an access door located on the buttplate. However, within the last few decades, most modern shoulder-fired weapons have eliminated the firearm's capability to house a cleaning kit or cleaning rod. As mentioned above, however, some firearms do feature a compartment for accessing a cleaning kit or related tools and components. This is often dependent upon the country of origin and the particular use of the firearm.

Currently, the United States government and other western countries use a variation of the ARMALITE Rifle, model number 15 (also known as the AR15). In the United States inventory, the improved version of the AR15 is the U.S. rifle Model No. 16 (known as M16). Also used in the United States inventory is a firearm utilizing the AR15 characteristics, but in a shorter form. This carbine is known as the U.S. carbine Model No. 4 (also known as the M4).

Even though the M16 and M4 are exact in function and somewhat compatible for parts interchangeability, they both differ in storage capability. The M16 features a trap door located in the buttstock, which accesses a small compartment for the rifle's cleaning kit. The M4 carbine does not offer such a compartment because of its size and multiple uses. The M4 has a smaller buttstock, which is collapsible to aid in making the firearm's overall length smaller.

This design was carried over originally from the early COLT Automatic Rifle Model No. 15 (also known as the CAR15). Making the firearm smaller is beneficial to help the shooter move safely and comfortably in confined areas or egress from a tight opening, such as an aircraft or a vehicle doorway. The M4 buttstock is not only collapsible, but also includes various intermediate extended positions providing for an adjustable overall length of the firearm.

The M4's buttstock telescopes along the carbine's receiver extension, which protrudes from the rear of the carbine. The M4 buttstock has the ability to lock onto the receiver extension in multiple positions providing the adjustable length. This aids various sized shooters by helping to better fit the firearm and/or assist in shoulder mounting the firearm over top of web/combat gear that the shooter might be wearing.

The M4 collapsible stock is in some cases considered to be too short, even with it fully extended outward. Also, the stock is sometimes found to be uncomfortable against the face of the shooter when the same is placed against the cheek weld. This is at least partly because of the uneven surfaces and sharp edges throughout the top surfaces of the buttstock.

Current military buttstocks, in both the rifle and carbine configurations, usually are of a basic design. The manufacturers and buyers of firearms typically require very little from the buttstock design. As such, other than comfort and strength, the buttstock has-few other requirements. Since the development of the earliest shoulder-fired firearms, the buttstock has simply been there for support in aiming the weapon, to transfer recoil action from the weapon to the shoulder of the shooter, and to aid in the comfort of the shooter.

During the early days of firearm development, the goal was to get a projectile from point "A" (the firearm muzzle) to point "B" (the target) the most accurate way possible. In the last twenty years, modern firearms are forced into new and unexpected roles. This is true, especially for the military and law enforcement market. Unfortunately, the roles change depending on mission requirements. So, the modern combat firearms have become a mounting platform for a variety of accessories. For example, a number of companies have developed mounting platforms that can be added to existing firearms or developed an integral mounting surface into the firearm's construction. These mounting platforms are usually located near the muzzle end of the firearm. This mentioned mounting platform is usually located on or around the firearm's barrel and has the ability to mount a number of accessories, such as lighting systems, night vision hardware, thermal imaging systems, surveillance equipment and hardware to aid the user in achieving the best accuracy possible.

With the array of items being mounted to the firearm, a number of things occur. First, the area for placement of this mounting hardware is limited. Second, by mounting the hardware in the forward portion of the firearm, the muzzle gets uncomfortably heavy. Excess muzzle weight leads to difficult target acquisition. Third, the mounted components can in some cases need supplies to maintain reliable function. Fourth, the mounted component can be too large or complex to mount solely to the muzzle end of the firearm. So, the component may need to be dispersed throughout the firearm balancing the firearm's overall weight. As such, it is desirable to develop a buttstock having the flexibility to mount additional accessories and provide mounting arrangement for future use.

One example of a modern buttstock that is known to have provisions for storing cylindrical objects, such as batteries, for example, is disclosed in U.S. Pat. No. 6,543,172 to Armstrong. This buttstock has an elongated central cavity and is supported on a firearm along that central cavity in a typical manner. The buttstock also includes an open-ended passage extending longitudinally along each side of the buttstock parallel with the central cavity. An elongated tube is received in each of the passages and forms a sliding fit therewith. The tubes each have one closed end and one open end. An end cap is used to seal the open end of each tube and thereby form a sealed cavity for storage purposes.

Such buttstocks, however, suffer from a number of shortcomings and disadvantages that limit the utility of the same. One disadvantage is that the passages that house the tubes are integrally formed on the buttstock. As a result, the buttstock includes provisions for two tubes even in cases in which it is desired to use only one tube. As such, the exterior profile of the buttstock cannot be adapted or changed as mission requirements or personal preference dictate. Another disadvantage is that the tubes comprise additional equipment components that must be accounted for so that the device is functional in the first instance, and that must be properly secured to minimize the chance of the tubes being lost or producing a rattle or other noise. As such, it is also desirable to develop a buttstock in which as many components as possible are secured to the buttstock frame to minimize the risk of loss while providing maximum mounting flexibility.

BRIEF DESCRIPTION

A buttstock for a firearm is provided and includes a buttstock frame and a buttstock accessory. The buttstock frame has a frame wall with an exterior surface. The buttstock accessory is supported on the buttstock frame along the exterior surface.

A buttstock for use on an associated firearm having an associated receiver extension is provided and includes a buttstock frame and a buttstock accessory. The buttstock frame has a frame wall with an interior surface, an exterior surface and a shoulder engaging surface. The interior surface at least partially forms a longitudinally extending frame passage for accepting the associated receiver extension. The buttstock accessory is supported on the buttstock frame in proximal relation to the exterior surface.

A buttstock kit for installation on an associated firearm having an associated receiver extension is provided and includes a buttstock frame, a buttstock accessory and a retaining member. The buttstock frame has a frame wall with an interior surface, an exterior surface and a shoulder engaging surface. The interior surface at least partially defines a frame passage adapted to accept the associated receiver extension. The buttstock accessory is supportable on the buttstock frame along the exterior surface. The retaining member is adapted to secure the buttstock frame on the associated receiver extension.

DETAILED DESCRIPTION

Figure 1:
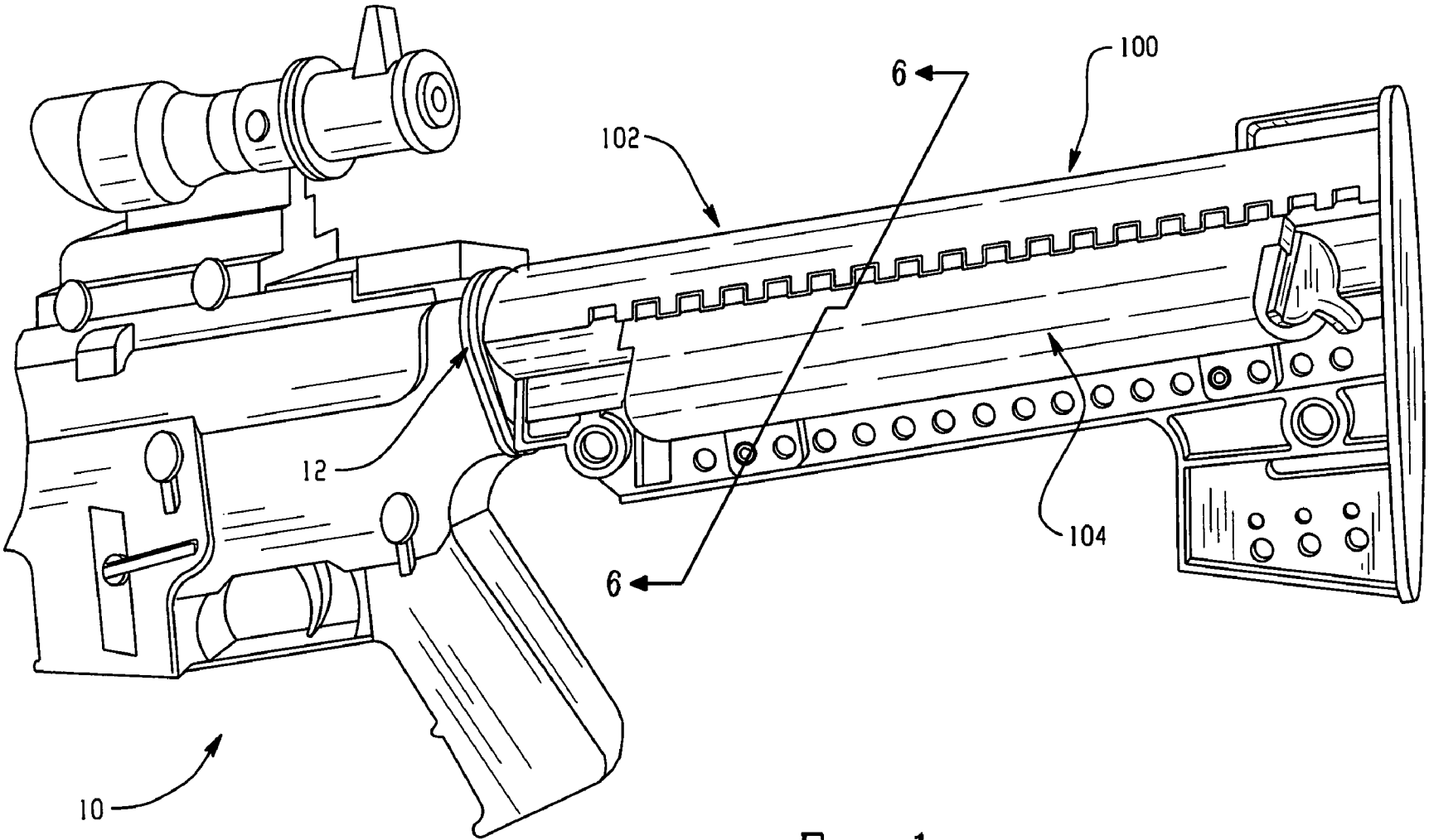
FIG. 1 is a perspective view of one embodiment of a modular buttstock shown assembled on a firearm in accordance with the present invention.

Referring now in greater detail to the drawings, wherein the showings are for the purpose of illustrating preferred embodiments of the invention only, and not for the purpose of limiting the invention, FIG. 1 illustrates a firearm 10 shown with a modular buttstock 100 in accordance with the present invention assembled thereon. Buttstock 100 includes a buttstock frame 102 and a buttstock accessory, such as a compartment 104, supported on the buttstock frame. It will be appreciated that the buttstock frame is skeletonized to have a minimal mass, and is suitable for use as a bare stock without any attachments. The buttstock frame acts as a bare mounting platform, and can be manufactured in any suitable length, shape or configuration to best fit the application or use of the firearm.

Figure 3:
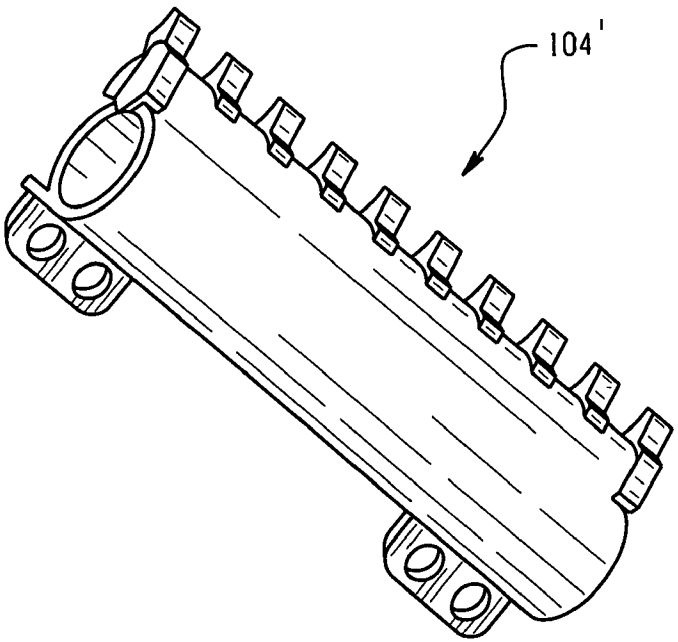
FIG. 3 is a perspective view of another embodiment of a buttstock accessory for use on a modular buttstock in accordance with the present invention.

Examples of suitable buttstock accessories are shown in FIGS. 2–5. Compartment 104, shown in FIG. 2, includes a compartment body 106 having a generally cylindrical passage 108 extending therethrough to form a compartment for storing supplies or other accessories, for example. A pair of spaced-apart tabs 110 and 112 extends from body 106, and each includes a pair of mounting holes 114. Extending from compartment body 106 generally opposite tabs 110 and 112 are a plurality of locking fingers or teeth 116. Compartment 104' in FIG. 3 is of shorter length but otherwise substantially identical to compartment 104 in FIG. 2. As such, it will be appreciated that buttstock accessories in accordance with the present invention can be of any suitable size or shape. For example, compartment 104 could be manufactured in various embodiments each having a different passage diameter, or with multiple smaller diameter passages extending parallel to one another. As such, compartments suitable for storing different use dependent supplies could be accommodated by simply switching from one compartment configuration to another.

Figure 5:
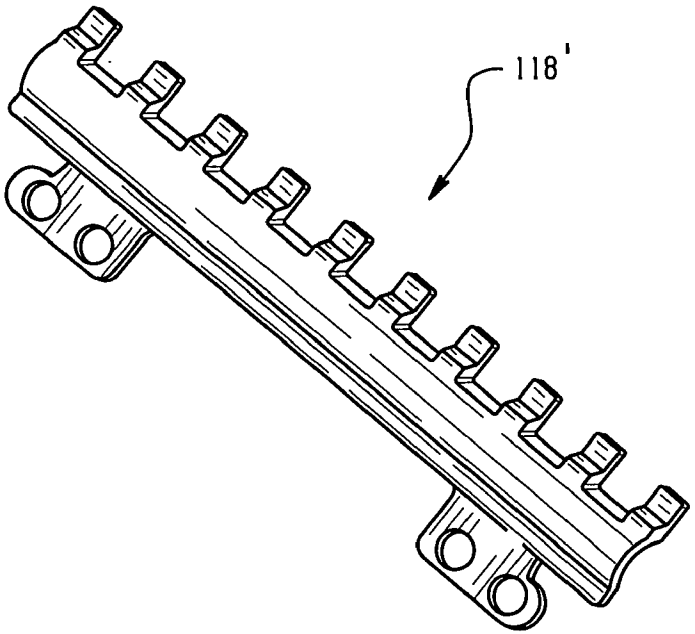
FIG. 5 is a perspective view of yet another embodiment of a buttstock accessory for use on a modular buttstock in accordance with the present invention.
Figure 4:
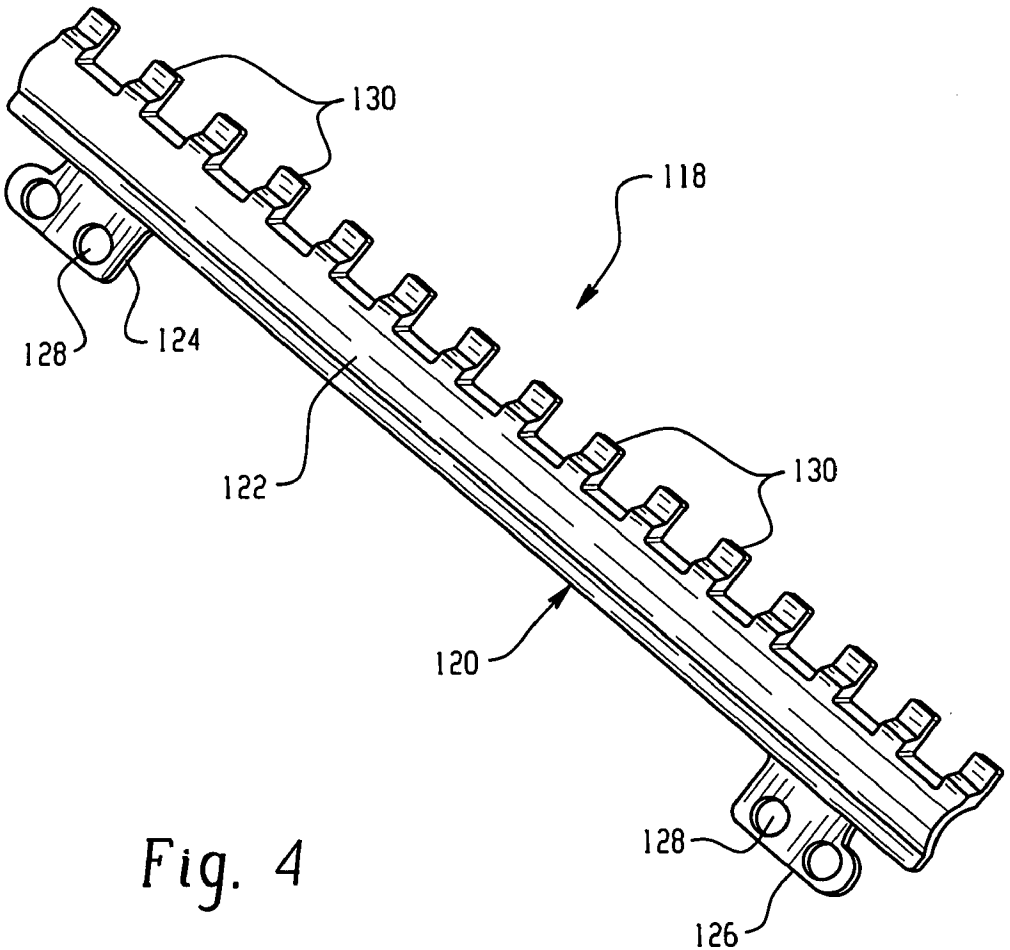
FIG. 4 is a perspective view of still another embodiment of a buttstock accessory for use on a modular buttstock in accordance with the present invention.

Cheek weld adapter 118, shown in FIG. 4, includes an adapter body 120, but does not include a cylindrical passage extending therethrough as in compartment 104. Rather, adapter body 120 has a contoured outer surface 122. Spaced-apart tabs 124 and 126 extend from body 120 and each include mounting holes 128. A plurality of locking fingers or teeth 130 extend from body 120 generally opposite tabs 124 and 126. Cheek weld adapter 118' in FIG. 5 is of shorter length but otherwise substantially identical to cheek weld adapter 118 shown in FIG. 4. One primary benefit of the cheek weld adapter is that the contoured outer surface provides a relatively smooth and comfortable resting place for the face of the shooter.

In addition to any of the buttstock accessories being of any suitable size and/or length, it will be further appreciated that buttstock accessories can be of any suitable shape, form or configuration, and formed from any suitable material. As such, buttstock accessories in accordance with the present invention are also intended to include instrumentation, electronic sensors or other equipment, such as lights or cameras, for example, that are adapted to and suitable for mounting on a buttstock frame in accordance with the present invention.

Figure 6:
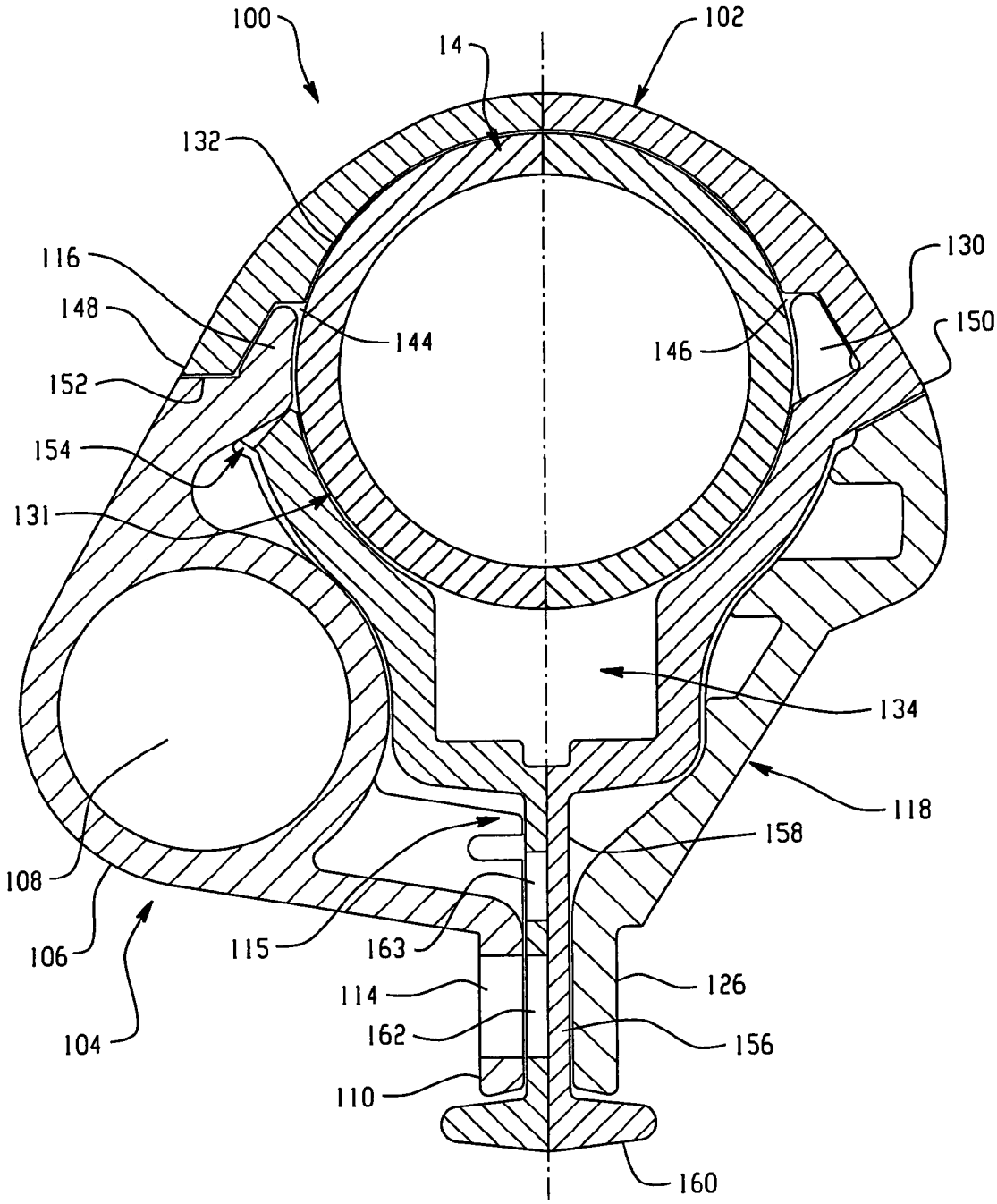
FIG. 6 is a cross-sectional view of the modular buttstock shown in FIG. 1 taken along line 6—6 thereof.

As shown in FIG. 1, firearm 10 includes a firearm body or receiver 12 that supports a generally cylindrical, hollow receiver extension 14, shown in FIG. 6. A pin (not shown) extends from the buttstock frame into a hole (not shown) in the receiver of the firearm in a known manner to counter any rotational force applied to the buttstock. A passage 131 extends through buttstock frame 102, and includes a generally cylindrical portion 132 and a radially outwardly extending groove portion 134. Portion 132 is suitably dimensioned to accept receiver extension 14.

Figure 7:
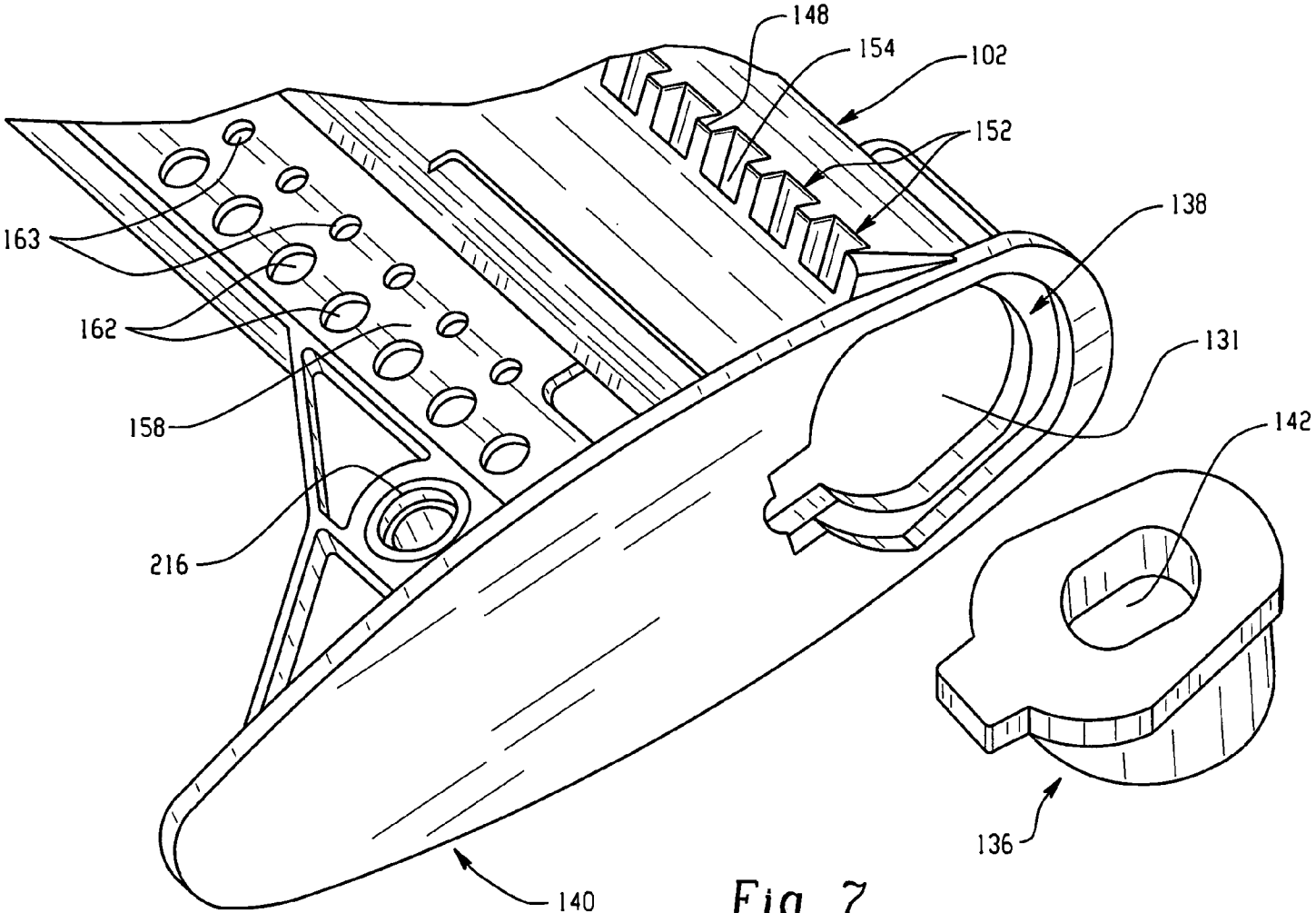
FIG. 7 is a perspective view of one embodiment of a mounting arrangement for attaching a modular buttstock to a firearm in accordance with the present invention.

Mounting grooves 144 and 146 extend along cylindrical portion 132 of passage 131. It will be appreciated that mounting grooves 144 and 146 are substantially identical and are given separate item numbers solely to distinguish between relative positions on buttstock frame 102. Ridges 148 and 150 extend along each side of buttstock frame 102 adjacent respective mounting grooves 144 and 146. As shown in FIGS. 6 and 7, a plurality of notches 152 are provided along each of ridges 148 and 150. The notches are of sufficient dimension to extend into the respective mounting grooves extending along passage 131. As such, a corresponding rectangular hole 154 extends through each of ridges 148 and 150 into the associated mounting groove at each notch. In one preferred embodiment, notches 152 are spaced apart from one another by about one-half of an inch (½"). However, it will be appreciated that any suitable dimension or configuration can be used.

Buttstock frame 102 can be retained on receiver extension 14 in any suitable manner. One example of a suitable arrangement is shown in FIG. 7, in which a buttstock frame 102 is retained on the receiver extension by a buttcap 136. The buttcap is received within a corresponding cavity 138 on buttplate 140 adjacent passage 131. The buttcap is secured within cavity 138 by a fastener (not shown) that extends through a hole 142 on buttcap 136 and engages a corresponding fastener receiving hole (not shown) in receiver extension 14 (FIG. 6). As such, the buttcap and buttstock frame can be secured on the receiver extension of the firearm in this manner.

Again referring to FIGS. 6 and 7, buttstock frame 102 also includes a mounting rail 156 extending generally parallel with passage 131. The mounting rail includes a web portion 158 and an flange portion 160. A plurality of mounting passages 162 extend through web portion 158. Mounting passages 162 are also preferably spaced apart from one another by about one-half of an inch (½"). As such, it is desirable to have notches 152 and passages 162 spaced apart at compatible distances so that the mounting flexibility for the accessories provided by the buttstock frame can be maximized. However, any suitable mounting dimensions can be used without departing from the scope and intent of the present invention.

Figure 8:
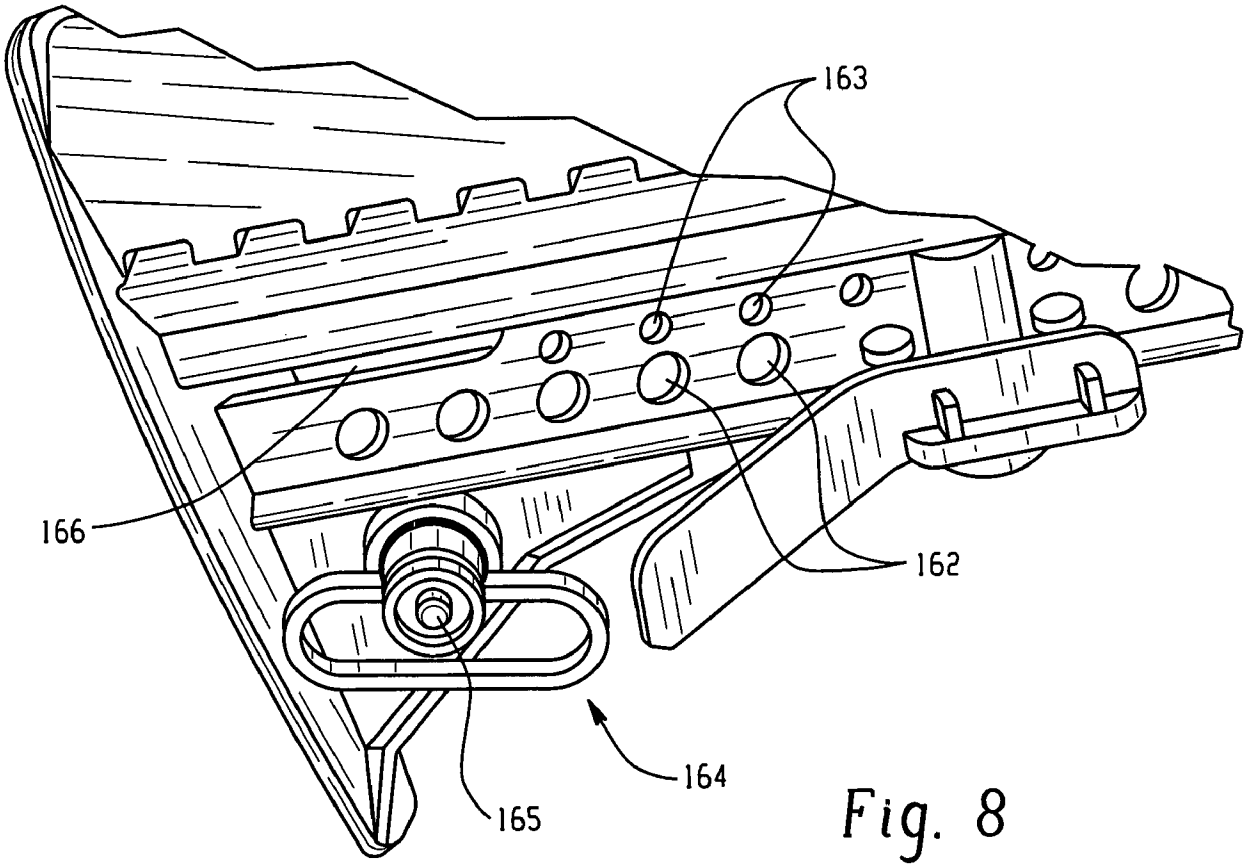
FIG. 8 is a perspective view of various mounting passages and hardware shown on a modular buttstock frame.

As shown in FIG. 8, secondary mounting holes 163, as well as other passages and/or slots can also be provided on the buttstock frame for mounting or attaching any other suitable accessory. It will be appreciated that secondary mounting holes 163 can be spaced apart from one another, in either or both the horizontal and vertical directions, by any suitable increment. For example, mounting holes 163 are shown in FIG. 8 as being spaced equally with passages 162 at about one-half of an inch (½") increments. However, any suitable spacing or increment can be used. For example, a swivel 164 can be supported on the buttstock frame adjacent slots 166 for attachment of a strap or sling (not shown).

Referring once again to FIG. 6, one or more of the buttstock accessories, such as compartments 104 and 104' and adapters 118 and 118', can be supported on buttstock frame 102. Each of the buttstock accessories has a plurality of teeth, such as teeth 116 and 130 on compartment 104 and adapter 118, respectively. The teeth are suitably spaced and dimensioned to interengage rectangular holes 154 extending through ridges 148 and 150 of the buttstock frame. Preferably, the teeth are space apart from one another at about one-half of an inch (½") increments to correspond with holes 154 and to align holes 114 and/or 128 with passages 162. However, any suitable increment can be used. As the teeth are fitted into the corresponding holes, and the buttstock accessory is properly seated onto the frame, the spaced-apart tabs, such as 110 and 112 or 124 and 126, for example, are positioned adjacent web portion 158 of mounting rail 156 so that the mounting holes, such as holes 114 or 128, for example, align with mounting passages 162 of rail 156. Preferably, each of the tabs is secured to the mounting rail by a suitable fastener arrangement. It will be appreciated that each of the buttstock accessories can be positioned in any one of many horizontal positions along a side of the buttstock.

Figure 9:
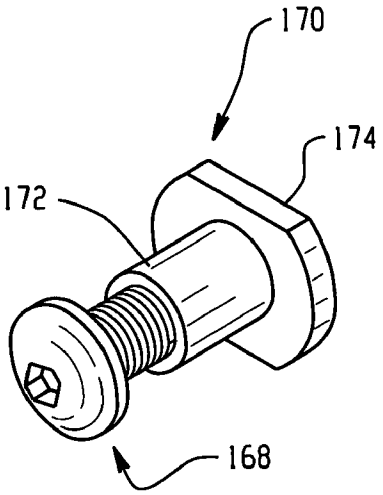
FIG. 9 is a perspective view of a fastener arrangement for securing a buttstock accessory to a modular buttstock frame.

One example of such a fastener arrangement is shown in FIG. 9 and includes a threaded fastener 168 and a threaded T-nut 170. The T-nut includes a cylindrical stem 172 and elongated flange 174 extending generally transverse the cylindrical stem. Preferably, the cylindrical stem of the T-nut is dimensioned to fit closely into the mounting holes of the accessory, as well as the mounting passages in the mounting rail. This acts to center the holes and passages and ensure alignment of the buttstock accessory on the buttstock frame. It will be appreciated, however, that any suitable fastener can be used to secure the buttstock accessory to the buttstock frame. For example, suitable rivets could be used for a more permanent mounting of an accessory on the buttstock frame.

Figure 2:
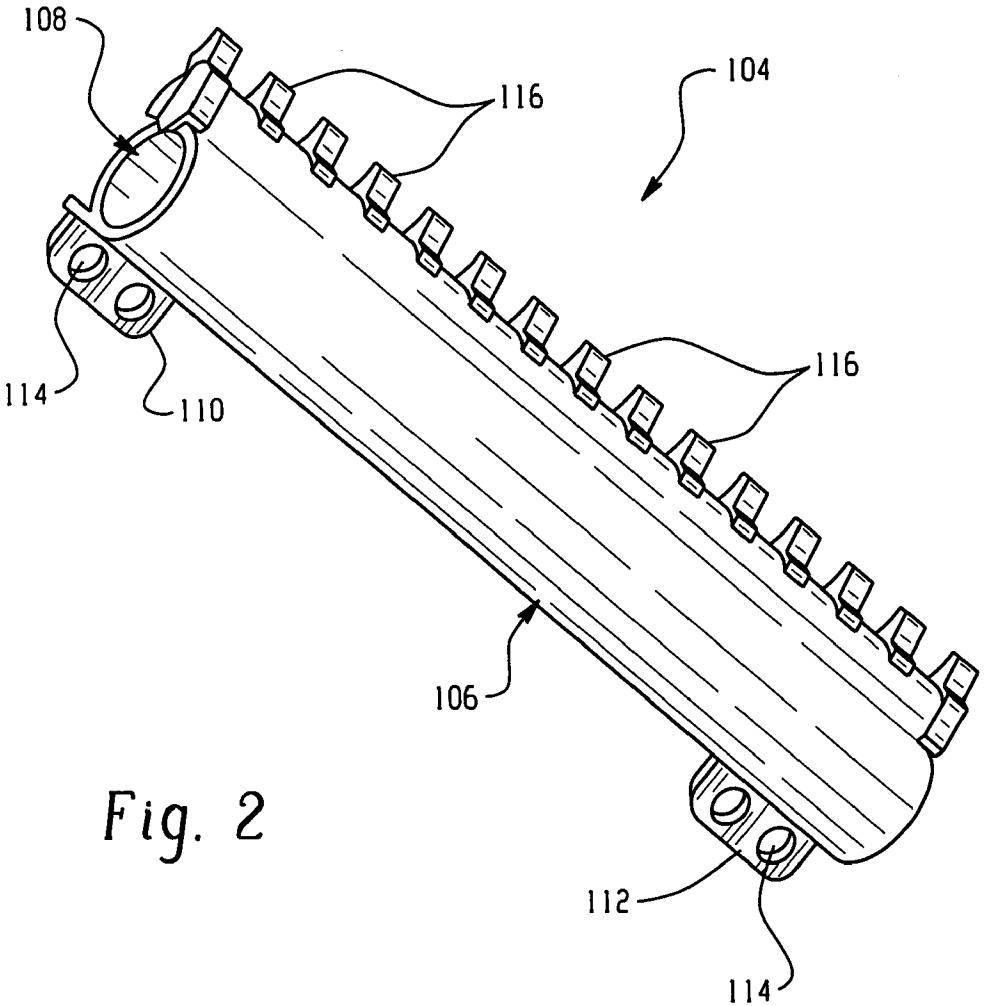
FIG. 2 is a perspective view of one embodiment of a buttstock accessory for use on a modular buttstock in accordance with the present invention.
Figure 10:
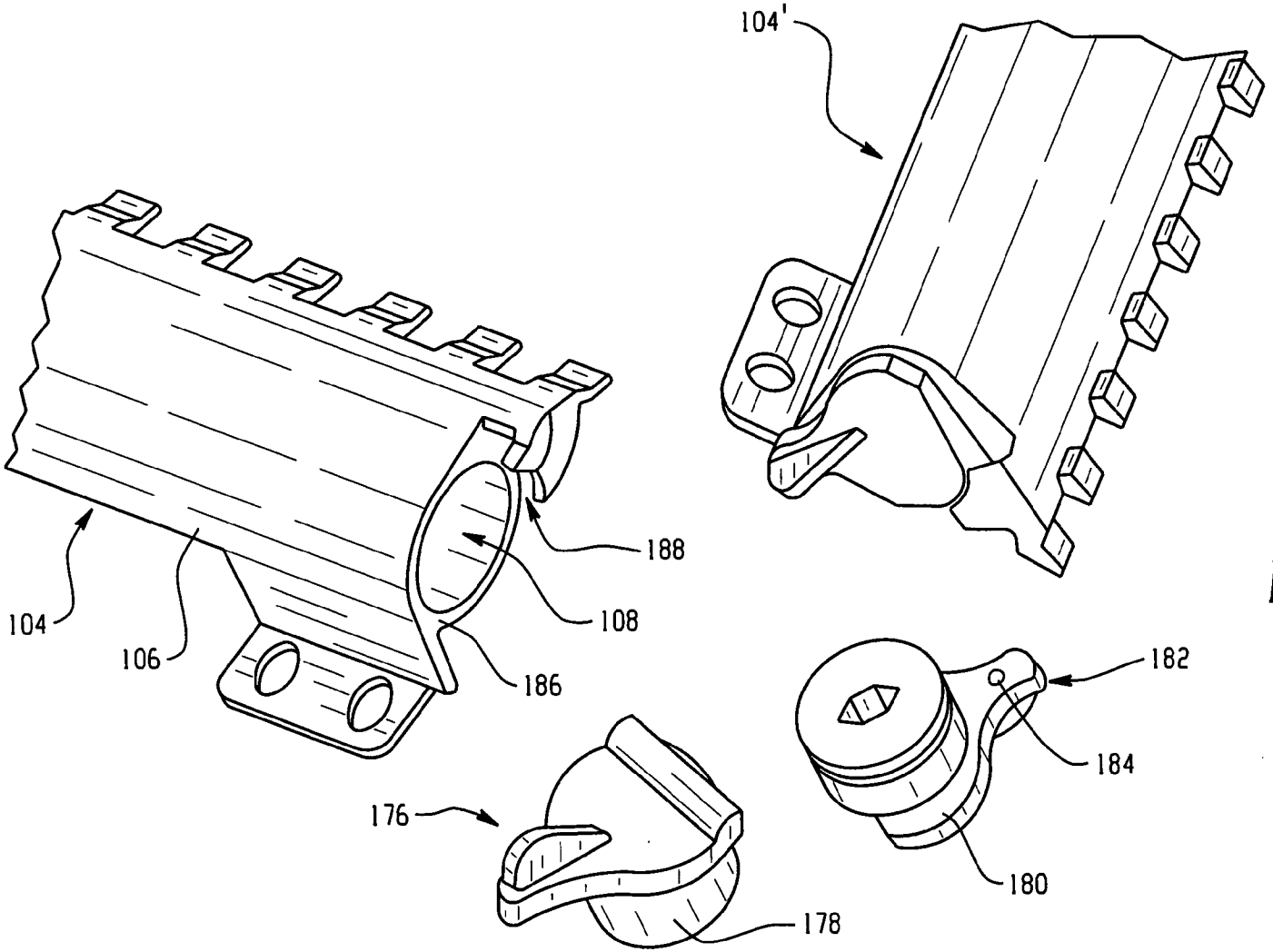
FIG. 10 is a perspective view of the buttstock accessories shown in FIGS. 2 and 3 with one embodiment of an end cap therefor.

FIGS. 2, 3 and 10 illustrate compartments 104 and 104'. As mentioned above, it should be appreciated that compartments 104 and 104' are substantially identical except for the relative lengths thereof. As such, the descriptions herein of compartment 104 are equally applicable to compartment 104' and, therefore, detailed descriptions will not be repeated with reference to item numbers of the latter compartment.

To form a compartment suitable for securely storing articles, passage 108 of compartment body 106 is preferably enclosed on both ends. End caps 176 are provided for forming a fluid-tight seal on each end, and include a generally cylindrical portion 178 suitably dimensioned to fit into an end of passage 108. The end caps also include a shoulder portion 180 extending radially outwardly from cylindrical portion 178 and a lever portion 182 projects from the shoulder portion. Extending axially from adjacent a thumb paddle or lever portion 182 in the direction of cylindrical portion 182 is a male detent 184 that is suitable for engaging a female detent (not shown) in an end wall 186 of compartment body 106. A notch 188 is provided in compartment body 106 adjacent each of end walls 186. The notch is suitable for at least partially receiving shoulder portion 180 to retain end cap 176 on the compartment body and to minimize the possibility of inadvertent removal of the end cap from the compartment. In use, cylindrical portion 178 is inserted into passage 108 until shoulder portion 180 engages end wall 186. Thereafter, the end cap is rotated into a locked position by a force applied to lever portion 182. The end cap is rotated until shoulder portion 180 engages notch 188, and male detent 184 engages the female detent to help minimize inadvertent rotation of the end cap. Additionally, a lanyard or other retaining device (not shown) can optionally be used to secure an end cap to the firearm. In one embodiment, a loop (not shown) on the end of the lanyard (not shown) slips over tab 115 (FIG. 6) of compartment 104 before the compartment is secured to mounting rail 156 of buttstock frame 102. Once the loop is fitted over the tab, the compartment is secured to the buttstock frame in the described manner. It will be appreciated from FIG. 6 that limited clearance between the distal end of the tab and the web portion of the mounting rail prevents the inadvertent removal of the loop from the tab. As such, the lanyard and end cap are securely retained on the firearm.

Figure 11:
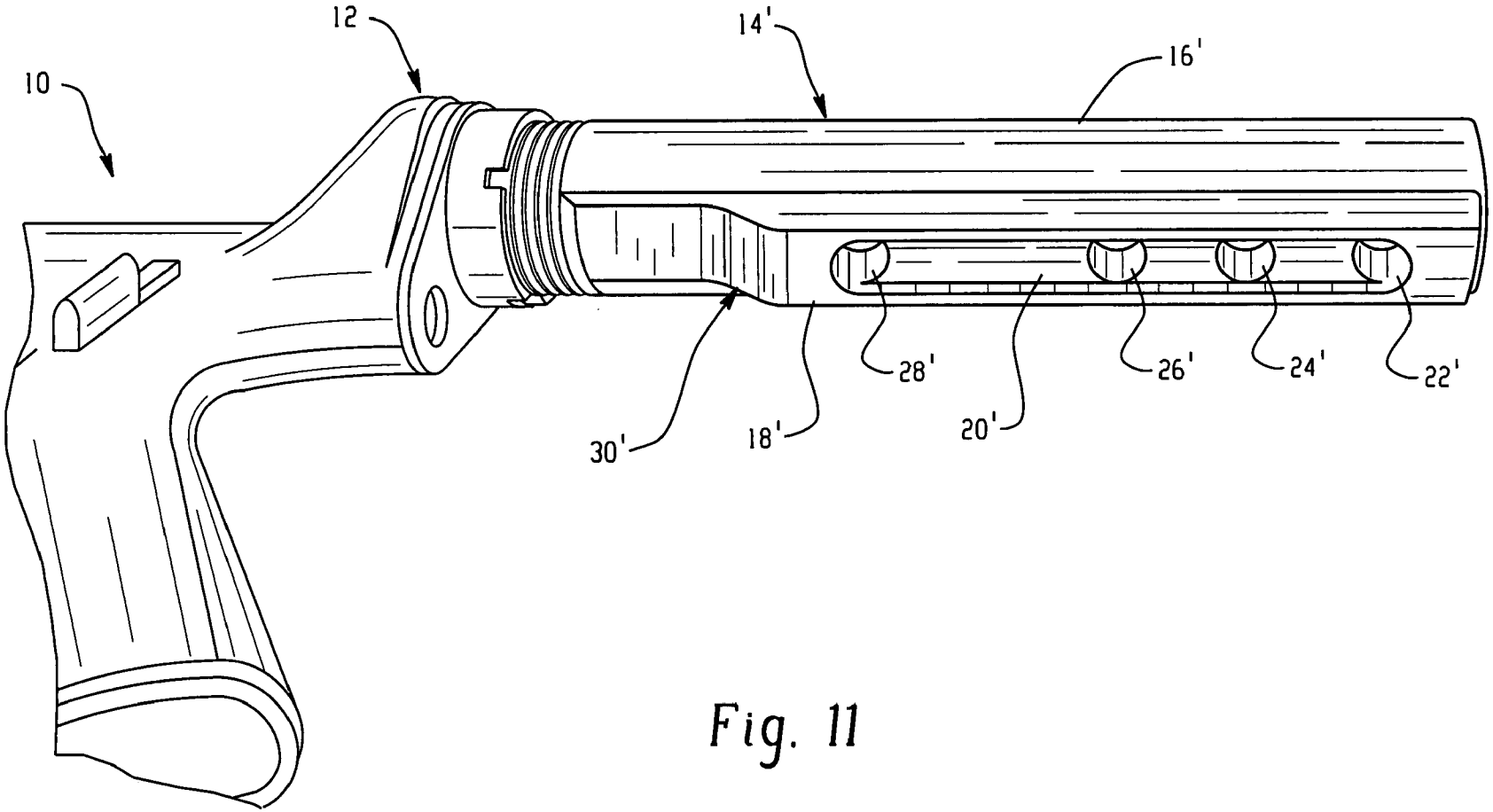
FIG. 11 is a perspective view of a known firearm and a known receiver extension having an indexing slot with indexing holes disposed there along.

It should be appreciated that other mounting arrangements can be used to secure buttstock frame 102 to a suitable receiver extension, in addition to the arrangement discussed above using buttcap 136 engaging buttplate 140. One example of an alternate mounting arrangement for securing a buttstock on a firearm 10 is shown in FIGS. 11–14. A receiver extension 14' of reduced length from that of receiver extension 14 is shown in FIG. 11, and includes a generally cylindrical portion 16' and a rib portion 18' extending along the cylindrical portion. Receiver extension 14' also includes an indexing slot 20' extending along the rib portion with indexing holes 22', 24', 26' and 28' disposed along the slot for providing variable mounting positions of the buttstock on the receiver extension. Additionally, receiver extension 14' includes a ramp portion 30' extending between cylindrical portion 16' and rib portion 18' adjacent receiver 12.

Figure 12:
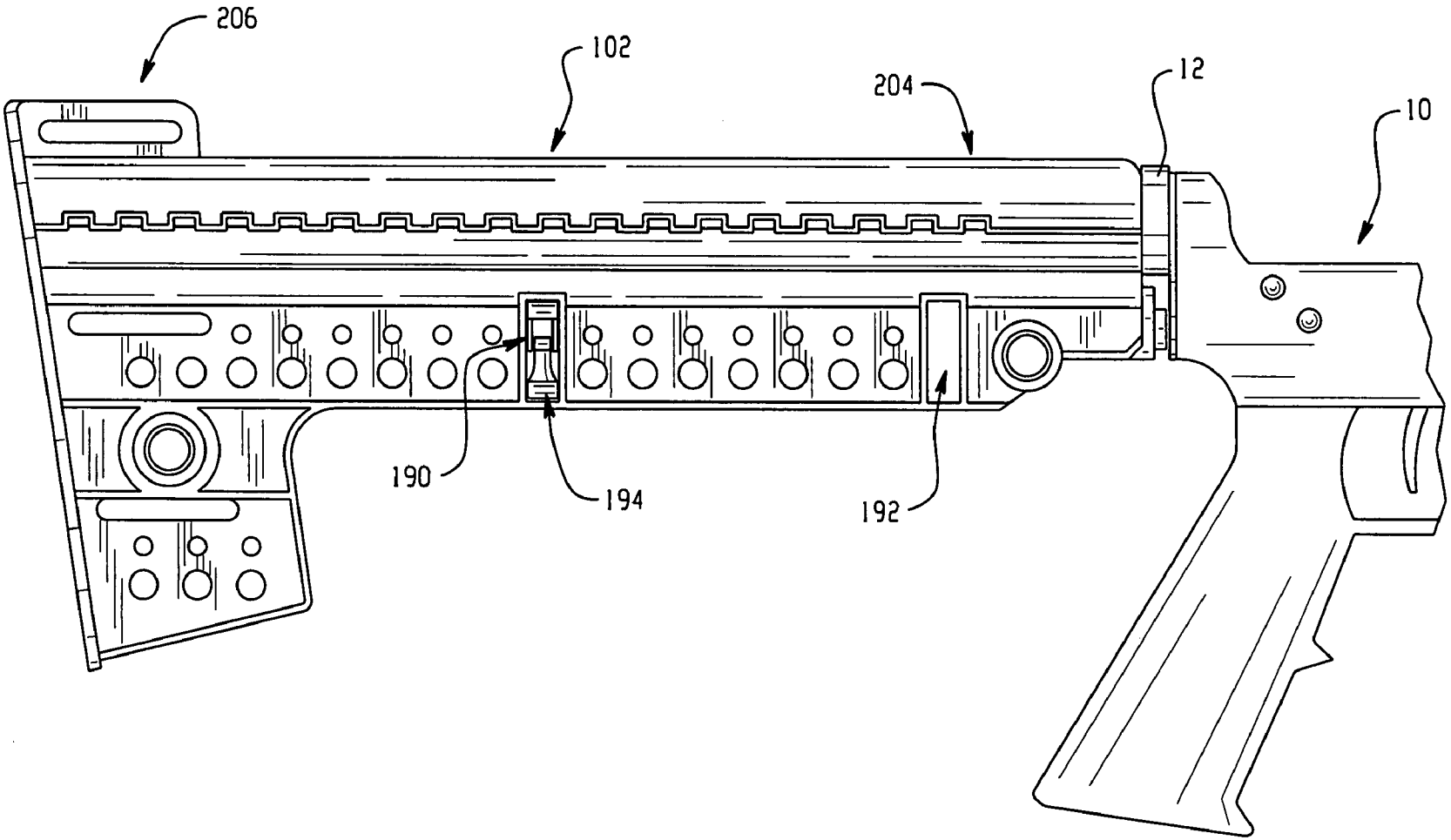
FIG. 12 is a perspective view of another embodiment of a mounting arrangement for attaching a modular buttstock to a firearm in accordance with the present invention.
Figure 13:
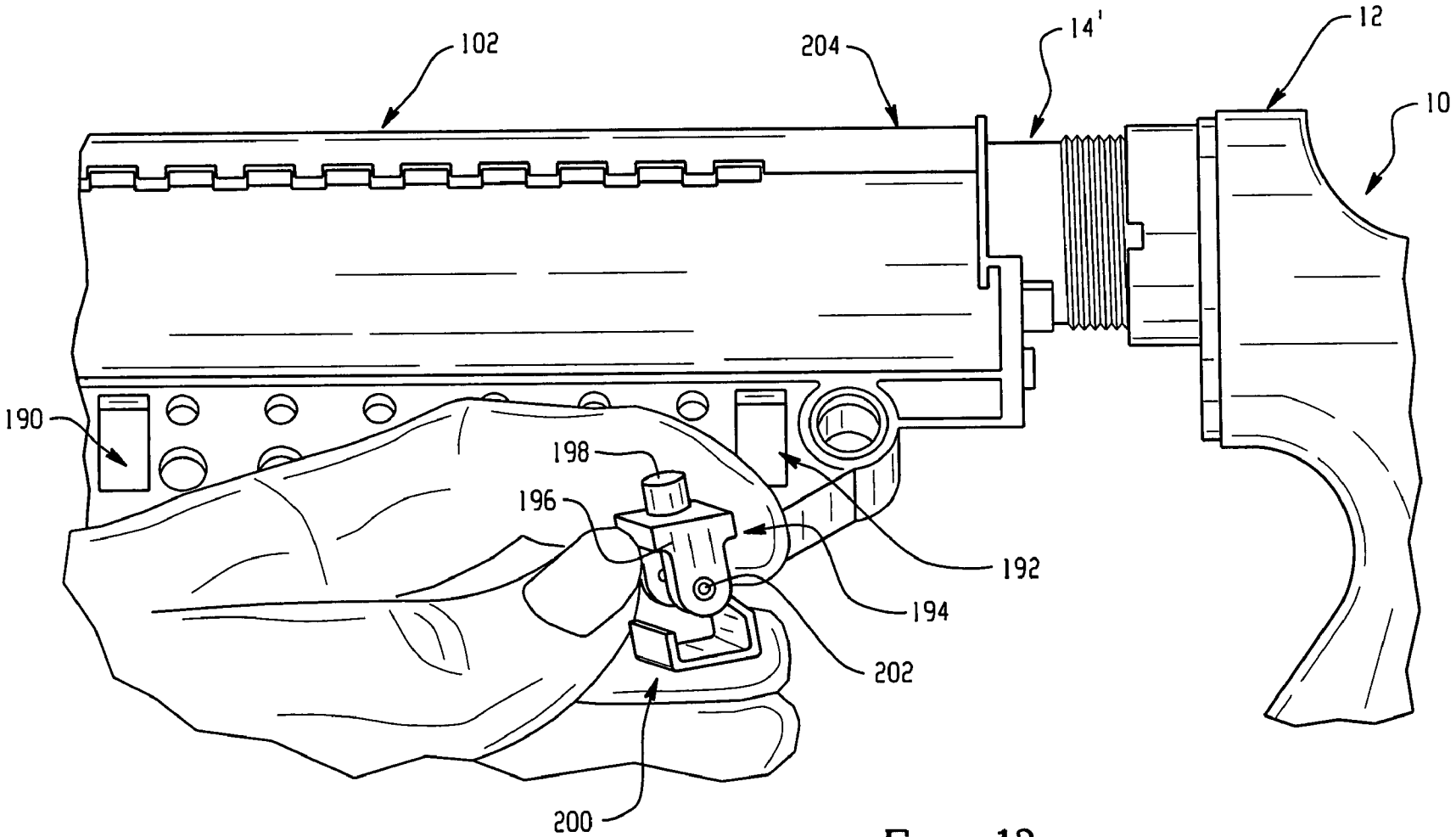
FIG. 13 is a perspective view of one embodiment of a manual locking pin for securing the modular buttstock to a firearm as shown in FIG. 12.
Figure 14:
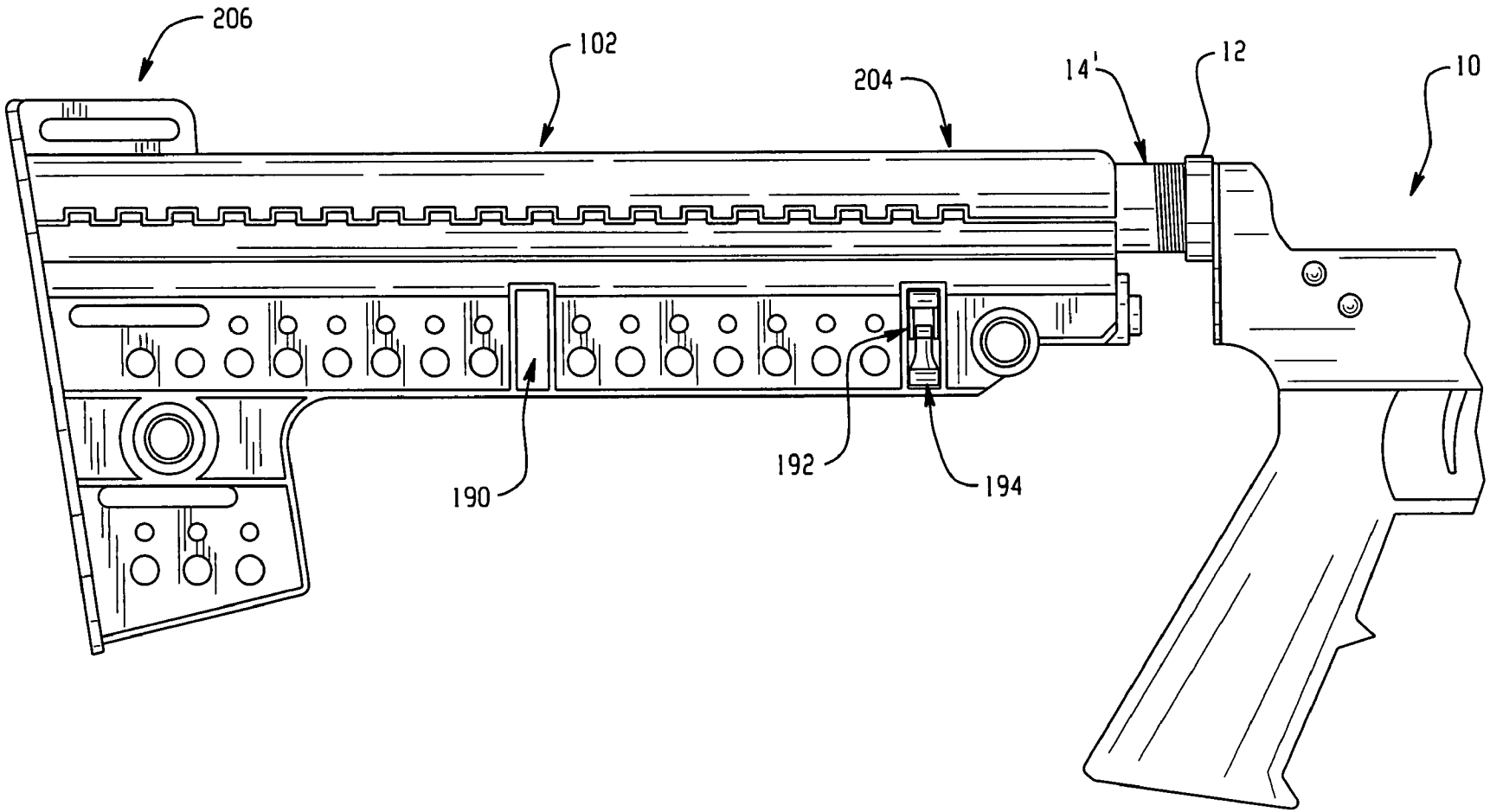
FIG. 14 is a perspective view of the buttstock and mounting arrangement shown in FIG. 12 with the buttstock mounted on the firearm in an extended position.

Turning to FIG. 12, buttstock frame 102 is positioned on receiver extension 14' such that one of locking ports 190 and 192 are aligned with one of the indexing holes of the receiver extension. As such, a manual locking pin 194 can be used to secure the buttstock frame on the receiver extension in either of the two positions shown in FIGS. 12 and 14. As can be better seen in FIG. 13, manual locking pin 194 includes a body 196 having a pin portion 198 extending therefrom. A pivot lock portion 200 is supported on body 196 by a pivot pin 202. As mentioned above, manual locking pin 194 can be received in either of locking ports 190 or 192 in buttstock frame 102, depending on the desired mounting position of the buttstock frame on the receiver extension. As shown in FIG. 12, where a first end 204 of buttstock frame 102 is in abutting engagement with receiver 12 of firearm 10, manual locking pin 194 is secured in locking port 190. As shown in FIG. 14, where first end 204 is spaced from receiver 12 of firearm 10, manual locking pin 194 is secured in locking port 192. It will be appreciated that pin portion 198 of manual locking pin 194 engages indexing hole 22' (FIG. 11) when the buttstock frame is in the position shown in FIG. 12, and engages indexing hole 28' (FIG. 11) when the buttstock frame is in the position shown in FIG. 14. It will be further appreciated that other intermediate mounting positions are contemplated and are intended to be included within the scope of this disclosure.

Figure 15:
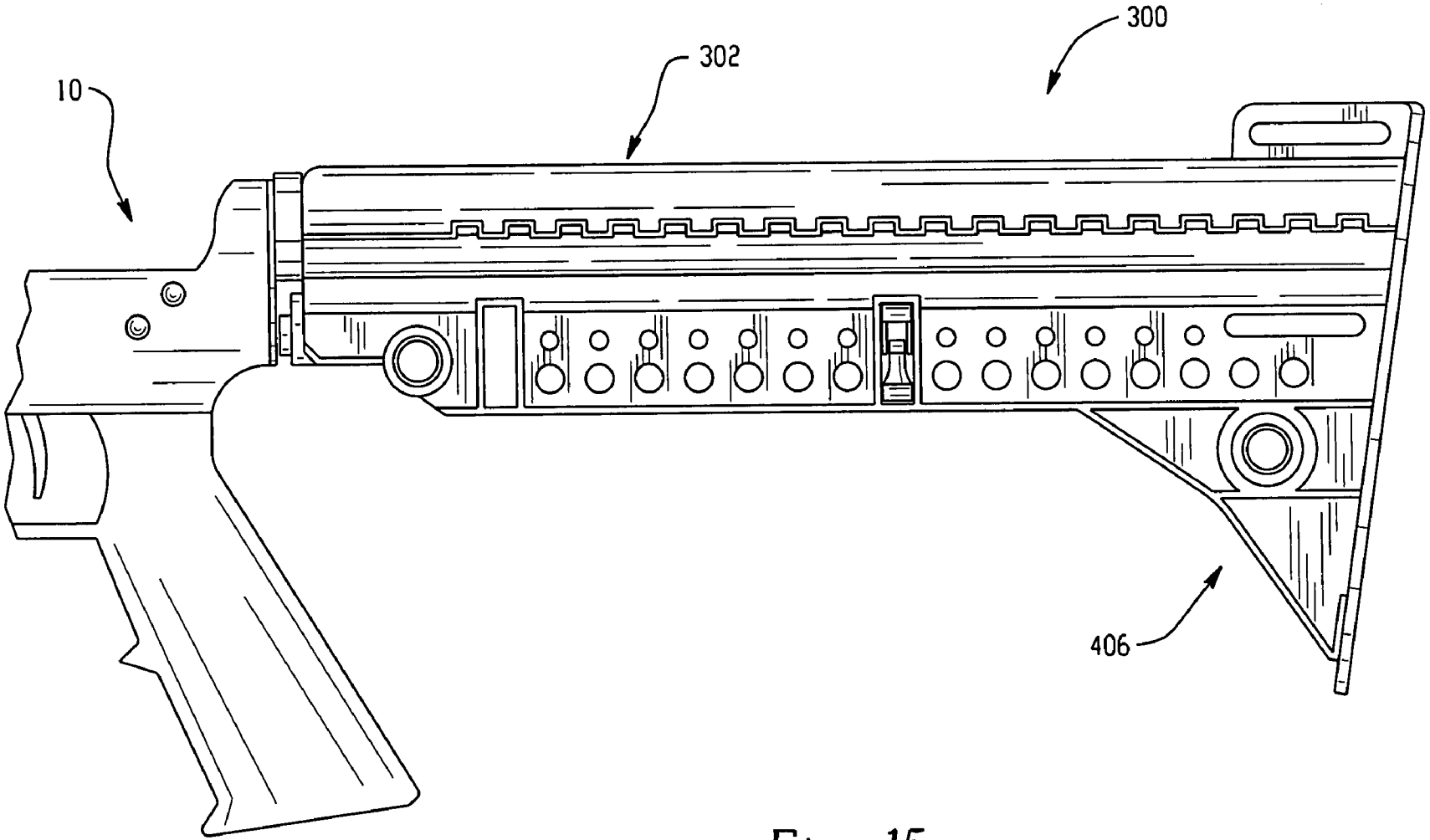
FIG. 15 is a perspective view of another embodiment of a modular buttstock shown assembled on a firearm in accordance with the present invention.

Another embodiment of a buttstock 300 in accordance with the present invention is shown in FIG. 15. Buttstock 300 includes a buttstock frame 302 and is adapted to receive one or more of the buttstock accessories (not shown) as discussed herein. It will be appreciated that buttstock frame 302 is substantially similar to buttstock frame 102 shown in and described with regard to FIGS. 1, 6 and 12–14, and can be secured on the receiver extension of the firearm in either of the above-discussed manners. However, second end 406 of buttstock frame 302 has a different profile from that of second end 206 on buttstock frame 102.

Figure 16:
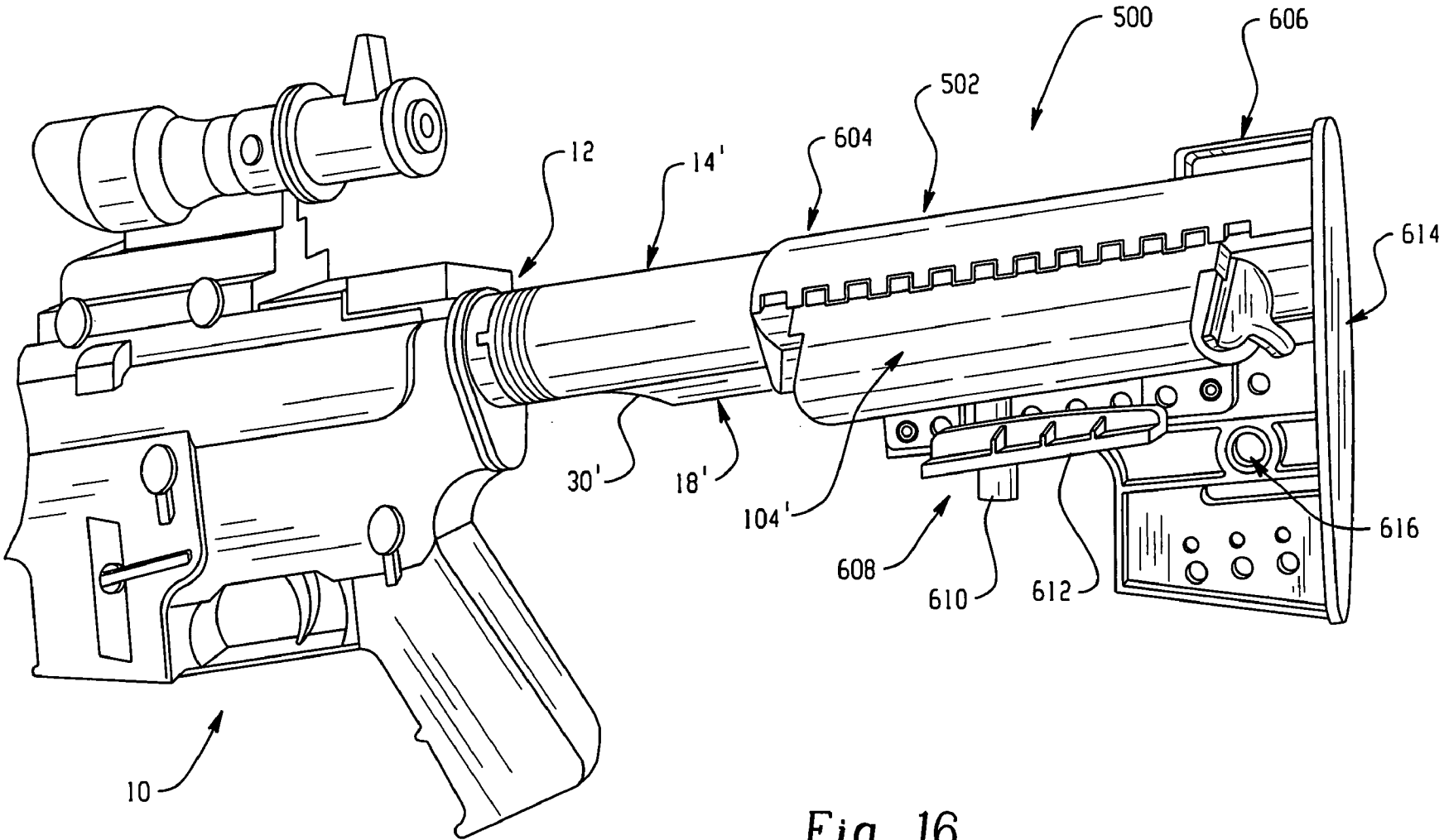
FIG. 16 is a perspective view of still another embodiment of a modular buttstock in accordance with the present invention shown assembled on a firearm.

Yet another embodiment of a buttstock 500 is shown in FIG. 16 supported on receiver extension 14' of firearm 10. Buttstock 500 includes a buttstock frame 502 and can include any suitable buttstock accessory, such as compartment 104', for example, shown supported on the buttstock frame. It will be appreciated from FIG. 16 that buttstock frame 502 and compartment 104' are significantly shorter in length when compared to buttstock frame 102 and accessory 104 shown in FIG. 1.

Additionally, FIG. 16 illustrates another example of mounting arrangement for securing a buttstock on a firearm 10. It can be observed that locking ports, such as ports 190 and 192 on frame 102, are not provided on buttstock frame 502. Rather, a spring-assisted locking pin 608 is provided on buttstock frame 502 and includes a spring-loaded pin 610 and a release lever 612. Whereas buttstock 100 is used in a generally fixed position on the firearm, buttstock 500 is designed to be quickly displaceable between collapsed and extended positions. In a collapsed position, first end 604 of buttstock frame 502 is in abutting engagement with receiver 12 of firearm 10. In such position, pin 610 is adjacent ramp portion 30' of rib portion 18' on receiver extension 14'. As buttstock 500 is moved from the collapsed position toward an extended position, spring-loaded pin 610 is displaced along ramp portion 30' and along rib 18' engaging indexing slot 20', which is shown in FIG. 11. The pin can then be moved between indexing holes 22', 24', 26' and 28', also shown in FIG. 11, using release lever 612 to disengage the pin.

Figure 17:
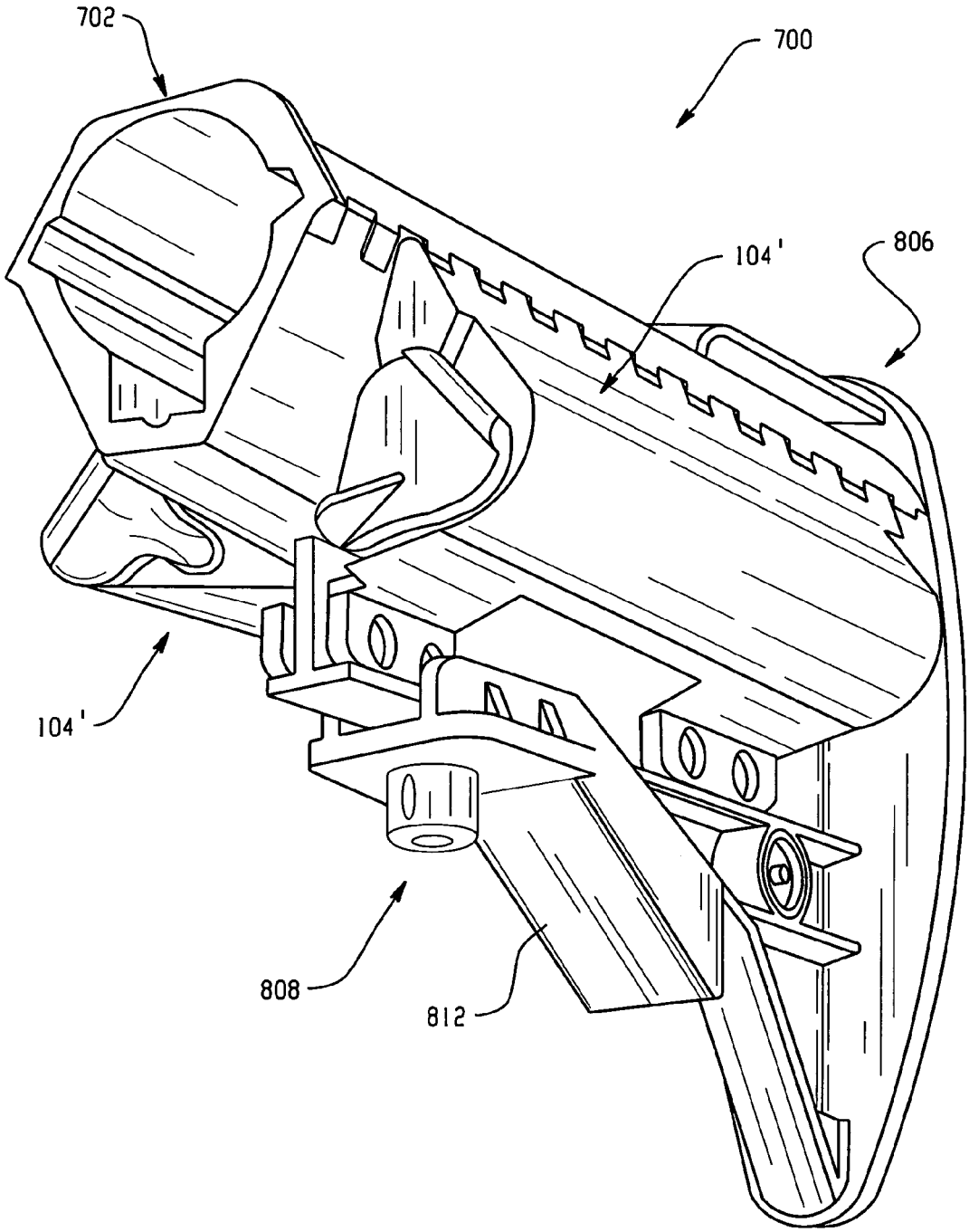
FIG. 17 is a perspective view of yet another embodiment of a modular buttstock in accordance with the present invention.

FIG. 17 illustrates still another embodiment of a buttstock 700 in accordance with the present invention. Buttstock 700 includes a buttstock frame 702 having a buttstock accessory supported on each side thereof. In FIG. 17, the buttstock accessories are compartments 104'. However, it will be appreciated that any suitable buttstock accessory can be used and supported on frame 702 in accordance with the present invention. It will be further appreciated that buttstock frame 702 includes a second end 806 that is substantially similar to second end 406 of buttstock frame 302. Buttstock 700, however, is retained on the receiver extension by a spring-assisted locking pin 808 and is displaceable between collapsed and extended positions, as discussed above with regard to FIG. 16.

The foregoing modular buttstocks and buttstock accessories can be manufactured from any suitable material, including a wide variety of polymeric, composite and/or metal materials. One polymeric material suitable for some components is nylon, and more specifically nylon 6/6. Another polymeric material suitable for other components is polypropylene, and more specifically glass-filled polypropylene. Additionally, the subject components can be manufactured by any suitable method or process, including extrusion, injection molding, machining, or any combination thereof. It will be appreciated that the present invention is not intended to be limited to any specific material, construction or method of manufacture.

The AR15/M16 rifle series normally has a receiver extension and a fixed buttstock. A longer buttstock has been developed in accordance with the present invention to fit this application, and is shown in FIGS. 1 and 15 as modular buttstocks 100 and 300, respectively. The CAR15/M4 carbine series features a shorter receiver extension that accepts a collapsible buttstock and is extensible into various positions on the receiver extension. A shorter, collapsible buttstock has been developed in accordance with the present invention for use on this carbine series, and is shown in FIGS. 16 and 17 as modular buttstocks 500 and 700, respectively. Additionally, buttstocks 100 and 300 that were developed for the rifle series can be mounted on a carbine series firearm as shown in FIGS. 12–14.

It will be appreciated from FIGS. 12 and 16, that second ends 206 and 606 of buttstocks 100 and 500, respectively, are substantially similar. For the purposes of this discussion, this style buttstock end will be referred to as a "clubfoot" style end. The second ends 406 and 806 of buttstocks 300 and 700, respectively, are likewise substantially similar, as shown in FIGS. 15 and 17. This style buttstock end will be referred to as a "standard" style end, as the silhouette or profile appearance of the end is similar to that of an original or standard buttstock.

The clubfoot variation is to aid the user in a firmer shooting position. This is possible when the user uses the free hand to grasp the clubfoot and compresses the stock against shoulder. Overall, this gives the shooter a stiffer platform when shooting the firearm in the "bench rest" or "prone" (laying down) position. The standard configuration is traditional and is favored by most of the shooting public.

Buttstock 100, shown in FIG. 1, can be used in place of the standard buttstock that normally comes standard on an AR15/M16 rifle. The installation of the buttstock is done by first removing the original buttstock. This is accomplished by unscrewing a fastener (not shown) located at the rear of the original buttstock, and then sliding the original buttstock off receiver extension 14. A buttstock frame 102 is then slid over receiver extension 14 until first end 204 of the buttstock frame firmly and squarely contacts receiver 12 of rifle 10. Next, depending upon the length of the buttstock and the length of the receiver extension, a buttstock spacer (not shown) can be inserted into passage 131 from adjacent buttplate 140 on second end 206. Buttcap 136 is inserted into cavity 138 in buttplate 140, which fills the remaining space in passage 131 and aligns flush with buttplate 140. By installing the fastener (not shown) through hole 142 in buttcap 136 and tightening the same into the receiver extension to the proper torque specifications, buttcap 136 will firmly compress the buttstock frame into the receiver of the firearm. It will be appreciated that the foregoing discussion is equally applicable to buttstock 300.

The shorter buttstock 500, shown in FIG. 16, mounts differently than the longer buttstocks discussed above. Like the original carbine collapsible stock, buttstock 500 features a spring-assisted locking pin 608, which mounts the stock securely to receiver extension 14' of firearm 10. Located on the bottom side of receiver extension 14' are indexing slot 20' and indexing holes 22', 24', 26' and 28'. It will be appreciated that different models of receiver extensions can have a different number of indexing holes. Spring-assisted locking pin 608 can be locked into any of the individual holes, depending on the overall stock length desired by the shooter. For example, the hole closest to the receiver of the firearm is the closed or collapsed position. The hole at the far end of the receiver extension is for placing the stock in its furthest, most extended position.

To move buttstock 500 along receiver extension 14' or to remove the buttstock from the same, spring-loaded pin 610 of spring-assisted locking pin arrangement 608 must be retracted from the indexing holes. This is achieved with the aid of release lever 612. The release lever is located toward a lower portion 614 of second end 606 of the buttstock frame, and works on a basic "teeter-totter" theory. By applying pressure at one end of release lever 612, the lever will pivot in the center and the opposite end will travel the opposite direction. This action, in turn, retracts spring-loaded pin 610. This operation retracts the pin enough to slide the stock along receiver extension 14'. To remove the stock, firmly grab the complete release lever and pull it downward and away from the stock until the complete lever assembly travels no further. Keeping pressure applied to the lever assembly, move the stock to the rear portion of the receiver extension until stock assembly is completely removed.

Two different release levers are available for the shorter buttstocks 500 and 700. One, shown in FIG. 17 as release lever 812, is of a traditional style used on the standard style buttstock. The other style, shown in FIG. 16 as release lever 612, is for use on the clubfoot style buttstocks. The clubfoot version can work on either the standard or clubfoot buttstock, but not vice versa. The clubfoot protrusion will interfere with the operation of a standard release lever. The clubfoot release lever, however, with its slotted or "U" shape, works around the clubfoot protrusion.

As discussed in detail above, longer buttstock frames 102 and 302 can also mount to a shorter receiver extension 14' for a carbine series firearm. This feature offers the shooter ability to have a longer length stock that the shorter buttstocks cannot provide. This feature can improve the comfort level of the shooter when the face of the same is placed onto a cheek weld adapter versus being placed partially on the receiver extension, which is normal when firing a standard carbine style firearm. Also, the longer buttstock further provides the ability to mount in two locations. One is a collapsed length where the buttstock is in abutting engagement with the receiver of the firearm, and the other is an extended length where the buttstock is space from the receiver about 8/10 of an inch.

Mounting a longer buttstock, such as buttstocks 100 and 300, to receiver extension 14' of a carbine style firearm is different than the practice of mounting the carbine and rifle buttstocks discussed above. When mounting a longer buttstock, the buttcap 136 and associated fastener (not shown) are not used. Instead, the longer buttstock mounts in a similar fashion to that of a shorter buttstock, but by using a manually locking pin 194, as shown in FIGS. 12–14, rather than a spring-assisted locking pin, such as 608 and 808 mentioned above. The manual locking pin includes a pin portion 198 that locks into an indexing hole in the carbine receiver extension, but is not spring assisted like the standard carbine spring-assisted locking pin.

Installing a longer buttstock, such as buttstocks 100 and 300, is done by sliding the buttstock frame onto the carbine style receiver extension until the buttstock is almost contacting the receiver extension nut securing the receiver extension to the receiver. Two locking ports 190 and 192 are provided on the web portion of the mounting rail, and extend upward through the frame into passage 131 that houses the receiver extension. Manual locking pin 194 installs into locking port 190 adjacent second end 206 of buttstock frame 102, and pin portion 198 of the manual locking pin locates and locks into indexing hole 22' on the receiver extension. With the manual locking pin 194 inserted, pivot lock portion 200, which is pivotally supported on body 196, is rotated downward until it contacts a ramping surface (not shown) located within the locking port adjacent flange portion 160 of mounting rail 156. Finally, pivot lock portion 200 is forced along the ramping surface until the pivot lock portion travels completely through the locking port and pivot lock portion 200 can travel no farther. At this point, the manual locking pin is secure, and the buttstock is locked into a fixed position on the firearm. It will be appreciated that the buttstock can be secured in other positions on the receiver extension, such as that shown in FIG. 14, for example, in which the overall length of the firearm can be lengthened by about 8/10 of an inch. The removal of the manual locking pin is done by apply pressure to the pivot lock portion from the other side of the buttstock until the pivot lock portion moves downward along the ramping surface. The manual locking pin can thereafter be removed from the locking port.

The manual locking pin has an additional feature for reducing the possibility of inadvertent removal of the locking pin from the locking port. Located on a tip (not shown) of pivot lock portion 200 is a security hole (not shown). In one preferred embodiment, the security hole has a diameter of about 5/100 of an inch, and is suitable to receive a wire, spring hairpin (not shown). In this embodiment, the hairpin can have a diameter of about 4/100 of an inch, and be of any suitable length, such as 15/16 of an inch. The hairpin is installed on the pivot lock portion, and keeps the same from backing out of the locking port within the buttstock.

Buttstocks in accordance with the present invention offer multiple sling mounting positions on the buttstock. Both the longer and shorter buttstocks offer conventional sling mounting provisions, similar to those on an original carbine buttstock. The buttstocks have one or more openings, such as slots 166 shown in FIG. 8, for example, on the second end thereof. Buttstocks of the clubfoot style can include three or more vertically spaced holes or slots, while those of the standard style commonly have two or more vertically spaced holes or slots.

The other way to mount a sling is with a detachable sling swivel. Both longer and shorter buttstocks are adapted to mount a detachable sling, ambidextrously. Quick-connect sling swivels include features to interlock with a sling lock sleeve, such as sleeves 216 and 616 respectively shown in FIGS. 7 and 16, for example. The sling lock sleeves are preferably anchored or otherwise integrally formed on the buttstock. Two or more sling lock sleeves are commonly provided on each buttstock.

The quick-connect sling swivel, such as swivel 164 shown in FIG. 8, has a number of retractable ball bearings (not shown). By pressing a detent button 165 located on the sling swivel, the ball bearings retract to allow the sling swivel to be removed from or installed into the sling lock sleeve. If, in one embodiment, the buttstock is manufactured by injection molding, the sling lock sleeve can be loaded into the mold before injection of the plastic/composite material. As with the slots discussed above, the sling lock sleeve will accept a quick-detachable sling swivel on either side of the buttstock ambidextrously.

What is claimed is:

1. A buttstock for a firearm comprising:

a buttstock frame having a forward end and an opposing rear end, said buttstock including a frame wall and one of a series of openings and a series of projections extending along said frame wall between said forward and rear ends; and, a buttstock accessory supported on said buttstock frame, said buttstock accessory including an accessory wall and the other of said series of openings and said series of projections extending alone said accessory wall;

said series of openings and said series of projections being adapted to interengage one another and at least partially secure said buttstock accessory on said buttstock frame.

2. A buttstock according to claim 1, wherein said frame wall has an interior surface at least partially forming a frame passage extending between said forward end and said rear end.

3. A buttstock according to claim 2, wherein said frame passage includes a groove extending along at least a portion of said frame passage.

4. A buttstock according to claim 2, wherein said buttstock frame includes a mounting rail between said forward end and said rear end.

5. A buttstock according to claim 4, wherein said buttstock accessory includes a mounting flange positioned adjacent said mounting rail.

6. A buttstock according to claim 5 further comprising a fastener securing said mounting flange along said mounting rail.

7. A buttstock according to claim 1, wherein said accessory wall has an interior surface and an exterior surface, said interior surface at least partially forming an accessory passage with an open end.

8. A buttstock according to claim 7 further comprising a cap secured on said buttstock accessory along said open end of said accessory passage.

9. A buttstock for use on an associate firearm having an associated receiver extension, said buttstock comprising:

a buttstock frame having a frame wall with an interior surface, an exterior surface, and a first series of uniformly-spaced mounting features disposed along said frame wall, said interior surface at least partially forming a frame passage for accepting the associated receiver extension; and, a buttstock accessory supported on said buttstock frame in proximal relation to said exterior surface, said buttstock accessory including a corresponding second series of uniformly-spaced mounting features adapted to interengage said first series of mounting features and at least partially secure said buttstock accessory on said buttstock frame.

10. A buttstock according to claim 9 further comprising a retaining member securing said buttstock frame on the associated receiver extension.

11. A buttstock according to claim 10, wherein said retaining member is an end member engaging said buttstock frame adjacent said frame passage.

12. A buttstock according to claim 10, wherein said buttstock frame includes a retaining passage extending generally transverse said frame passage and said retaining member is a retaining pin extending through said retaining passage and engaging the associated receiver extension.

13. A buttstock according to claim 12, wherein said retaining pin is retractably supported on said buttstock frame.

14. A buttstock kit for installation on an associated firearm having an associated receiver extension, said kit comprising:

a buttstock frame having a frame wall with an interior surface, an exterior surface, and a plurality of evenly-spaced openings extending into said frame wall, said interior surface at least partially defining a frame passage adapted to accept the associated receiver extension;

a buttstock accessory including an accessory wall and a plurality of evenly-spaced projections extending from said accessory wall, said plurality of projections being cooperable with said plurality of openings and adapted to at least partially support said buttstock accessory on said buttstock frame along said exterior surface thereof; and, a retaining member adapted to secure said buttstock frame on the associated receiver extension.

15. A buttstock kit according to claim 14, wherein said accessory wall includes an interior surface and an exterior surface, said interior surface at least partially forming an accessory passage.

16. A buttstock kit according to claim 15 further comprising a cap securable on said buttstock accessory along said accessory passage.

17. A buttstock according to claim 1, wherein said series of openings are evenly spaced-apart at a first interval distance, and said series of projections are evenly space-apart at a second interval distance.

18. A buttstock according to claim 17, wherein said first interval distance and said second interval distance are substantially equal.

19. A buttstock according to claim 17, wherein at least one of said first interval distance and said second interval distance is about ½ of an inch.

20. A buttstock according to claim 1, wherein said series of openings is disposed along said frame wall, and at least an opening of said series of openings extends through said frame wall into a passage extending along said buttstock frame.

21. A buttstock according to claim 20, wherein said passage includes a groove extending along at least a portion thereof, and an opening of said series of openings extends through said frame wall and into said passage along said groove.

22. A buttstock according to claim 20, wherein said opening is substantially rectangular.

23. A buttstock according to claim 4, wherein at least one of said frame passage and said mounting rail extends substantially entirely between said forward end and said rear end.

24. A buttstock according to claim 1 further comprising a buttplate supported on said buttstock frame at said rear end.

25. A buttstock according to claim 24, wherein said buttplate is integrally formed on said buttstock frame.

26. A buttstock according to claim 1, wherein said buttstock frame includes one of a second series of openings and a second series of projections extending along said frame wall.

27. A buttstock according to claim 26 further comprising a second buttstock accessory supported on said buttstock frame, said second buttstock accessory including a second accessory wall and including the other of said second series of openings and said second series of projections.

28. A buttstock according to claim 9, wherein one of said first series of uniformly-spaced mounting features and said second series of uniformly-spaced mounting features includes an opening, and the other of said first series of uniformly-spaced mounting features and said second series of mounting features includes a projection.

29. A buttstock according to claim 14, wherein said buttstock frame includes a mounting rail extending at least partially between opposing ends of said buttstock frame.

* * * * *

UNITED STATES PATENT AND TRADEMARK OFFICE

CERTIFICATE OF CORRECTION

PATENT NO. : 6,925,744 B2
APPLICATION NO. : 10/843246
DATED : August 9, 2009
INVENTOR(S) : Eric Stephen Kincel It is certified that error appears in the above-identified patent and that said Letters Patent is hereby corrected as shown below:

Column 12, line 41, of claim 1 should read as follows:

of projections extending along said accessory wall;

Signed and Sealed this

Twenty-ninth Day of September, 2009

David J. Kappos

David J. Kappos
*Director of the United States Patent and Trademark Office*